US010718564B2

(12) United States Patent
Matsubara et al.

(10) Patent No.: US 10,718,564 B2
(45) Date of Patent: Jul. 21, 2020

(54) GAS LIQUEFACTION APPARATUS AND GAS LIQUEFACTION METHOD

(71) Applicant: Mitsubishi Heavy Industries Engineering, Ltd., Kanagawa (JP)

(72) Inventors: Wataru Matsubara, Tokyo (JP); Atsuhiro Yukumoto, Tokyo (JP); Nobuyuki Nishioka, Tokyo (JP); Hiroyuki Furuichi, Tokyo (JP); Takeo Shinoda, Tokyo (JP); Hiroshi Shiomi, Tokyo (JP)

(73) Assignee: Mitsubishi Heavy Industries Engineering, Ltd., Kanagawa (JP)

( * ) Notice: Subject to any disclaimer, the term of this patent is extended or adjusted under 35 U.S.C. 154(b) by 0 days.

(21) Appl. No.: 15/542,223

(22) PCT Filed: Jan. 4, 2016

(86) PCT No.: PCT/JP2016/050019

§ 371 (c)(1),
(2) Date: Jul. 7, 2017

(87) PCT Pub. No.: WO2016/111258

PCT Pub. Date: Jul. 14, 2016

(65) Prior Publication Data

US 2017/0356687 A1 Dec. 14, 2017

(30) Foreign Application Priority Data

Jan. 9, 2015 (JP) ..... 2015-003546

(51) Int. Cl.
*F25J 1/02* (2006.01)
*F25J 1/00* (2006.01)

(52) U.S. Cl.
CPC ..... *F25J 1/0022* (2013.01); *F25J 1/004* (2013.01); *F25J 1/0035* (2013.01); *F25J 1/0037* (2013.01);

(Continued)

(58) Field of Classification Search
CPC ..... F25J 1/0022; F25J 1/0035; F25J 1/0037; F25J 1/004; F25J 2230/20; F25J 2245/90; F25J 2220/64
See application file for complete search history.

(56) References Cited

U.S. PATENT DOCUMENTS 3,818,714 A * 6/1974 Etzbach ..... F25J 1/0022 62/612
4,421,537 A * 12/1983 Kuraoka ..... F25J 1/0007 62/608

(Continued)

FOREIGN PATENT DOCUMENTS

JP 2003-517561 A 5/2003
JP 2010-537151 A 12/2010

OTHER PUBLICATIONS

International Search Report issued in corresponding International Application No. PCT/JP2016/050019 dated Mar. 1, 2016, with translation (5 pages).

(Continued)

*Primary Examiner* — Brian M King
(74) *Attorney, Agent, or Firm* — Osha Liang LLP

(57) ABSTRACT

A gas liquefaction apparatus includes at least a source-gas supply line that supplies source gas; a room-temperature heat exchanger, a preliminary-cooling heat exchanger, and a liquefaction/supercooling heat exchanger that are provided in series sequentially in the source-gas supply line and that cool the source gas; a separation drum that separates the source gas containing a condensate, which has been cooled by heat exchange up to a liquefaction temperature of the source gas or below, into a gas component and a liquefied component; and a refrigerant-gas supply line that uses a gas component separated by the separation drum as refrigerant gas to supply the refrigerant gas in a direction opposite to a supply direction of the source gas, in order of the liquefaction/supercooling heat exchanger, the preliminary-cooling heat exchanger, and the room-temperature heat exchanger.

8 Claims, 7 Drawing Sheets

(52) U.S. Cl.
CPC ..... *F25J 1/0202* (2013.01); *F25J 1/0203* (2013.01); *F25J 1/0288* (2013.01); *F25J 2220/64* (2013.01); *F25J 2230/20* (2013.01); *F25J 2245/90* (2013.01); *F25J 2270/06* (2013.01)

(56) References Cited

U.S. PATENT DOCUMENTS

| | | | | |
|---|---|---|---|---|
| 4,435,198 | A * | 3/1984 | Gray | F25J 1/0022 62/622 |
| 6,220,053 | B1 * | 4/2001 | Hass, Jr. | F25J 1/0015 62/613 |
| 6,378,330 | B1 * | 4/2002 | Minta | F25J 1/0035 62/613 |
| 2003/0177785 | A1 | 9/2003 | Kimble et al. | |
| 2009/0217701 | A1 * | 9/2009 | Minta | F25J 1/0022 62/612 |
| 2010/0186445 | A1 | 7/2010 | Minta et al. | |
| 2011/0023536 | A1 * | 2/2011 | Jager | F25J 1/0022 62/611 |
| 2013/0118204 | A1 * | 5/2013 | Higginbotham | F25J 1/0015 62/615 |
| 2016/0003529 | A1 | 1/2016 | Minta et al. | |

OTHER PUBLICATIONS

Written Opinion of the International Searching Authority issued in PCT/JP2016/050019 dated Mar. 1, 2016, with translation (7 pages).

* cited by examiner

GAS LIQUEFACTION APPARATUS AND GAS LIQUEFACTION METHOD

FIELD

The present invention relates to a gas liquefaction apparatus and a gas liquefaction method in which, for example, natural gas is liquefied as liquefied natural gas.

BACKGROUND

A process of liquefying, for example, natural gas (NG) as liquefied natural gas (LNG) employs a so-called "closed loop type" in which a refrigerant having a specific composition (for example, nitrogen ($N_2$) and a mixed refrigerant) is used and the refrigerant for exclusive use is circulated as a closed system. Therefore, there are following issues as the small- and mid-sized liquefaction process of natural gas in which a simple apparatus is desired.

1) A refrigerant manufacturing facility and a storage facility are required, or when the refrigerant is not manufactured, it is required to purchase the refrigerant.

2) When a mixed refrigerant is used as the refrigerant in the closed loop type, if a feed composition changes, the refrigerant composition needs to be adjusted, which is troublesome. Further, because mixing of the refrigerants needs to be performed accurately, time is required for the startup and the plant stability. Therefore, if shut-down and restart are repeated frequently, this process is not suitable.

3) When nitrogen ($N_2$) is used as the refrigerant in the closed loop type, it is generally required to boost the nitrogen refrigerant pressure to a high pressure equal to or higher than 80 kg/cm$^2$. Therefore, facilities such as a compressor and supply facilities such as piping and valves become expensive.

Therefore, in recent years, a technique of an open loop cycle process in which the natural gas is directly used as the refrigerant has been proposed (Patent Literature 1).

CITATION LIST

Patent Literature

Patent Literature 1: Japanese Patent Application National Publication No. 2010-537151

However, according to the proposal described in Patent Literature 1, a plurality of cooling loops are required in a heat exchange area, and heat exchange facilities become complicated. Therefore, emergence of a technique that realizes further facility cost reduction and power reduction has been desired.

SUMMARY

One or more embodiments of the present invention provide a gas liquefaction apparatus and a gas liquefaction method in which the heat exchange facilities are simple and facility cost reduction and power reduction are realized.

The first aspect of the present disclosure includes a gas liquefaction apparatus. The gas liquefaction apparatus includes: a source-gas supply line for supplying source gas; a room-temperature heat exchanger, a preliminary-cooling heat exchanger, and a liquefaction/supercooling heat exchanger that are provided in series sequentially in the source-gas supply line to cool the source gas; a separation drum that separates the source gas containing a condensate, which has been cooled by heat exchange up to a liquefaction temperature of the source gas or below, into a gas component and a liquefied component; a refrigerant-gas supply line that uses a gas component separated by the separation drum as refrigerant gas to supply the refrigerant gas in a direction opposite to a supply direction of the source gas, in order of the liquefaction/supercooling heat exchanger, the preliminary-cooling heat exchanger, and the room-temperature heat exchanger, thereby cooling the source gas; a compressor provided at an end portion of the refrigerant-gas supply line to compress the refrigerant gas used for cooling; a compressed-gas extraction line for extracting compressed gas compressed by the compressor from the compressor; a mixing unit that mixes the compressed gas with the source gas by connecting an end of the compressed-gas extraction line to the source-gas supply line at an upstream side of the room-temperature heat exchanger; an extraction line branched from the source-gas supply line at either one of or both of a position between the room-temperature heat exchanger and the preliminary-cooling heat exchanger or a position between the preliminary-cooling heat exchanger and the liquefaction/supercooling heat exchanger to extract a part of the source gas heat-exchanged; an expansion turbine connected with an end of the extraction line to adiabatically expand a part of the source gas extracted; and a cooling source-gas supply line for supplying cooling source gas temperature-dropped in the expansion turbine to the refrigerant-gas supply line at an upstream side of the liquefaction/supercooling heat exchanger.

The second aspect of the present disclosure includes a gas liquefaction apparatus. The gas liquefaction apparatus includes: a source-gas supply line for supplying source gas; a room-temperature heat exchanger, a preliminary-cooling heat exchanger, and a liquefaction/supercooling heat exchanger that are provided in series sequentially in the source-gas supply line to cool the source gas by heat exchange with refrigerant gas; a separation drum provided at an end portion of the source-gas supply line to separate cooled source gas containing a condensate into a gas component and a liquefied component; a refrigerant-gas supply line that uses the gas component separated by the separation drum and cooled as refrigerant gas to supply the refrigerant gas in a direction opposite to a supply direction of the source gas, in order of the liquefaction/supercooling heat exchanger, the preliminary-cooling heat exchanger, and the room-temperature heat exchanger, to cool the source gas; a compressor provided at an end portion of the refrigerant-gas supply line to compress the refrigerant gas; a compressed-gas extraction line for extracting compressed gas compressed by the compressor; a mixing unit that mixes the compressed gas with the source gas by connecting an end of the compressed-gas extraction line to the source-gas supply line on an upstream side of the room-temperature heat exchanger; a first extraction line branched from the source-gas supply line between the room-temperature heat exchanger and the preliminary-cooling heat exchanger to extract a part of the source gas heat-exchanged in the room-temperature heat exchanger; a warm expansion turbine connected with an end of the first extraction line to adiabatically expand a part of the source gas extracted; a first cooling-source-gas supply line for supplying first cooling source gas temperature-dropped in the warm expansion turbine to the refrigerant-gas supply line between the preliminary-cooling heat exchanger and the liquefaction/supercooling heat exchanger; a second extraction line branched from the source-gas supply line between the preliminary-cooling heat exchanger and the liquefaction/supercooling heat exchanger to extract a part of the source gas heat-exchanged in the preliminary-cooling heat exchanger; a cold expansion turbine connected with an end of the second extraction line to adiabatically expand a part of the source gas extracted; and a second cooling-source-gas supply line for supplying second cooling source gas temperature-dropped in the cold expansion turbine to the refrigerant-gas supply line between the liquefaction/supercooling heat exchanger and the separation drum.

The third aspect of the present disclosure includes the gas liquefaction apparatus in the second aspect. In the gas liquefaction apparatus, the liquefaction/supercooling heat exchanger is divided into two heat exchangers to form a liquefaction heat exchanger and a supercooling heat exchanger, and the liquefaction heat exchanger and the supercooling heat exchanger are provided in series, and the first cooling source gas temperature-dropped in the warm expansion turbine is branched into two parts, and branched first cooling source gas is respectively supplied to a refrigerant-gas supply line between the preliminary-cooling heat exchanger and the liquefaction heat exchanger, and that between the liquefaction heat exchanger and the supercooling heat exchanger.

The fourth aspect of the present disclosure includes the gas liquefaction apparatus in any one of the first to third aspect. In the gas liquefaction apparatus, a cooler that cools the source gas is provided in the source-gas supply line at an upstream side of the room-temperature heat exchanger.

The fifth aspect of the present disclosure includes the gas Liquefaction apparatus in any one of the first to fourth aspect. In the gas liquefaction apparatus, a heavy component separator that separates a heavy component from an extraction liquid acquired by extracting a part of the source gas is provided.

The sixth aspect of the present disclosure includes the gas liquefaction apparatus in any one of the first to fifth aspect. In the gas liquefaction apparatus, a boil-off gas supply line for supplying boil-off gas is provided on an upstream side of the compressor connected to the refrigerant-gas supply line.

The seventh aspect of the present disclosure includes a gas liquefaction method of an open loop cycle process in which source gas is cooled up to a liquefaction temperature to manufacture a gas liquefied substance from a cooled gas component and a liquefied component. The gas liquefaction apparatus includes: a heat-exchange step of heat-exchanging the cooled gas component as refrigerant gas in at least two heat exchanging units, while supplying the refrigerant gas in a direction opposite to a supply direction of the source gas; an adiabatic expansion step of extracting a part of cooled source gas between the heat exchanging units and adiabatically expanding the part of the source gas; and a refrigerant-gas supply step of supplying cooling source gas temperature-dropped at the adiabatic expansion step to the refrigerant gas.

According to one or more embodiments of the present invention, a part of the heat-exchanged source gas is extracted at either one of or both of a position between the room-temperature heat exchanger and the preliminary-cooling heat exchanger or a position between the preliminary-cooling heat exchanger and the liquefaction/supercooling heat exchanger, and is adiabatically expanded in the expansion turbine, thereby acquiring the temperature-dropped cooling source gas. The acquired cooling source gas is joined with the refrigerant gas to acquire a sufficient cooling amount for sequentially cooling the source gas in the respective heat exchangers. Accordingly, the heat exchange facilities have a simple configuration, thereby enabling to reduce the facility cost and power.

BRIEF DESCRIPTION OF DRAWINGS

FIG. 2-1 is a schematic diagram of a gas liquefaction apparatus according to a second embodiment.

FIG. 2-2 is a schematic diagram of a gas liquefaction apparatus according to a test example 1.

FIG. 5-1 is a schematic diagram of a gas liquefaction apparatus according to a fifth embodiment.

FIG. 5-2 is a schematic diagram of a gas liquefaction apparatus according to a test example 2.

DESCRIPTION OF EMBODIMENTS

Embodiments of the present invention will be described in detail below with reference to the accompanying drawings. The present invention is not limited to the embodiments, and there are a plurality of embodiments, combinations thereof are also included in the present invention.

First Embodiment

Figure 1:
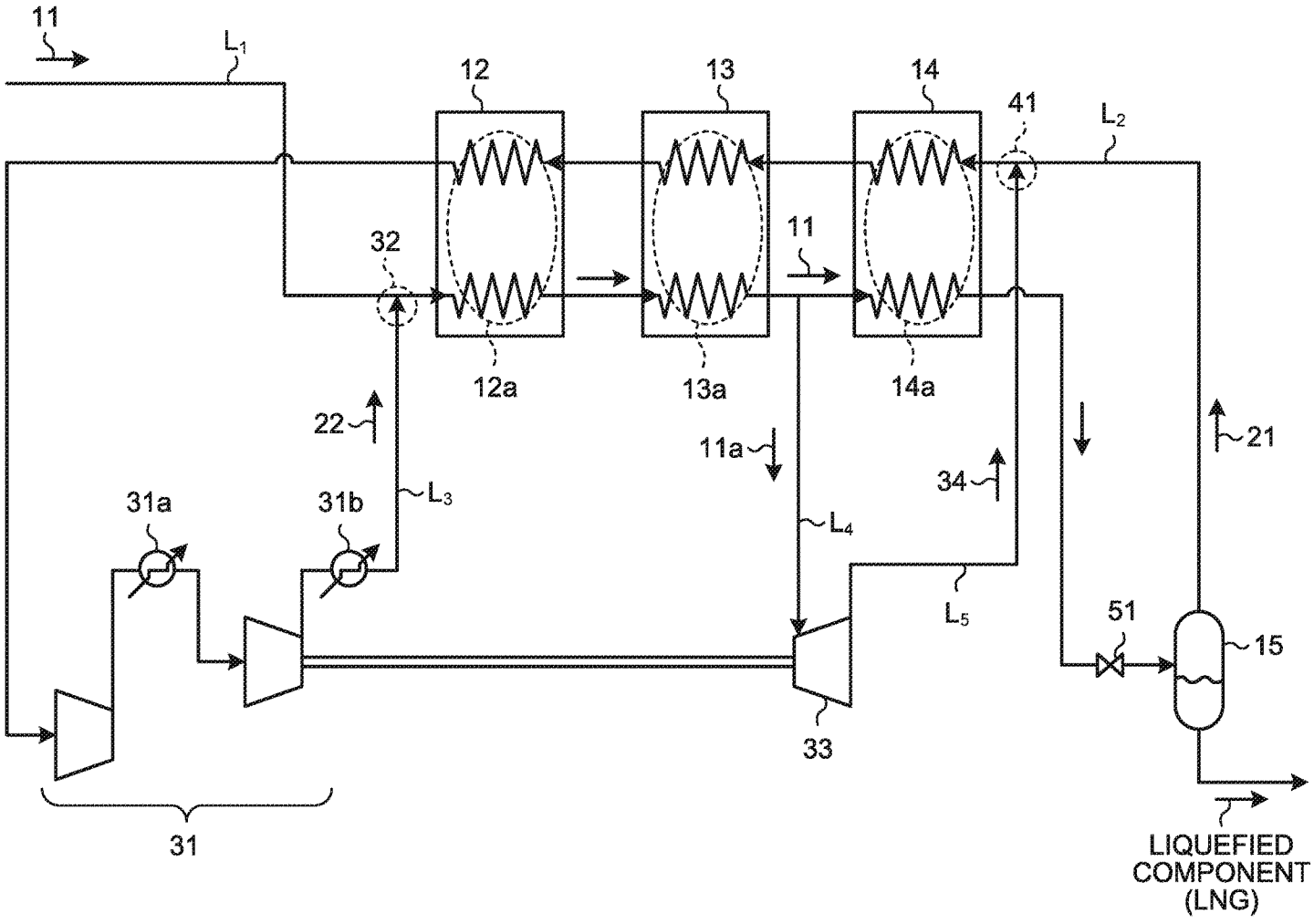
FIG. 1 is a schematic diagram of a gas liquefaction apparatus according to a first embodiment.

FIG. 1 is a schematic diagram of a gas liquefaction apparatus according to a first embodiment. As illustrated in FIG. 1, a gas liquefaction apparatus 10A according to the present embodiment includes a source-gas supply line $L_1$ for supplying a source gas 11 such as natural gas, and a room-temperature heat exchanger 12, a preliminary-cooling heat exchanger 13, and a liquefaction/supercooling heat exchanger 14 that are provided in series sequentially in the source-gas supply line $L_1$ to cool the source gas 11. The gas liquefaction apparatus 10A also includes a separation drum 15 that is provided at an end portion of the source-gas supply line $L_1$ to separate the source gas 11 containing a liquefied condensate cooled by heat exchange to a liquefaction temperature or below of the source gas 11 into a gas component and a liquefied component. The gas liquefaction apparatus 10A also includes a refrigerant-gas supply line $L_2$ for supplying refrigerant gas 21 in a direction opposite to a supply direction of the source gas 11, in order of the liquefaction/supercooling heat exchanger 14, the preliminary-cooling heat exchanger 13, and the room-temperature heat exchanger 12, by using the gas component separated by the separation drum 15 as the refrigerant gas 21 to cool the source gas 11 to be introduced therein by respective heat exchanging units 12*a*, 13*a*, and 14*a*. The gas liquefaction apparatus 10A also includes a compressor 31 provided at an end portion of the refrigerant-gas supply line $L_2$ to compress the refrigerant gas 21 used for cooling, a compressed-gas extraction line $L_3$ for extracting compressed gas 22 compressed by the compressor 31 from the compressor 31, and a mixing unit 32 that mixes the compressed gas 22 with the source gas 11, an end of the compressed-gas extraction line $L_3$ is connected to the source-gas supply line $L_1$ at an upstream side of the room-temperature heat exchanger 12. The gas liquefaction apparatus 10A also includes an extraction line $L_4$ branched from the source-gas supply line $L_1$ between the preliminary-cooling heat exchanger 13 and the liquefaction/supercooling heat exchanger 14 to extract a part 11*a* of the source gas 11 heat-exchanged. Further, the gas liquefaction apparatus 10A includes an expansion turbine 33 connected with an end of the extraction line $L_4$ to adiabatically expand the part 11*a* of the source gas 11 extracted, and cooling source-gas supply line $L_5$ for supplying a cooling source gas 34 temperature-dropped in the expansion turbine 33 to the refrigerant-gas supply line $L_2$ at an upstream side of the liquefaction/supercooling heat exchanger 14.

According to the present embodiment, for example, natural gas (NG) containing methane as a main component is used as the source gas 11, which is liquefied to become liquefied natural gas (LNG). The pressure of the natural gas is, for example, about 30 kg/cm$^2$ to 70 kg/cm$^2$ supplied by a pipeline. Other than the natural gas, it can be applied in a case when air is to be liquefied, for example.

According to the present embodiment, the source-gas supply line $L_1$ forms a liquefaction line of a supply gas stream for supplying the source gas 11, and the refrigerant-gas supply line $L_2$ forms a cooling line of a refrigerant gas stream for supplying the refrigerant gas 21. At a position where heat exchange is performed between these two lines, the room-temperature heat exchanger 12, the preliminary-cooling heat exchanger 13, and the liquefaction/supercooling heat exchanger 14 are provided sequentially as heat exchange units. The source gas 11 supplied by the source-gas supply line $L_1$ is indirectly cooled in the heat exchanging units 12*a*, 13*a*, and 14*a* by the refrigerant gas 21 supplied in an opposite direction by the refrigerant-gas supply line $L_2$. At this time, an open loop cycle process in which the unliquefied gas component of the source gas 11 is utilized as the refrigerant gas 21 is realized in an end zone of the liquefaction line.

According to the present embodiment, as the heat exchanging units 12*a*, 13*a*, and 14*a* respectively installed inside the room-temperature heat exchanger 12, the preliminary-cooling heat exchanger 13, and the liquefaction/supercooling heat exchanger 14, for example, a plate-fin type heat exchanger is used. However, the heat exchanging unit is not limited thereto, so long as it is a unit that efficiently performs heat exchange of the source gas 11 by using the refrigerant gas 21.

The room-temperature heat exchanger 12 performs heat exchange of the source gas 11 at a room temperature (for example, 20° C. to 40° C.) by the refrigerant gas 21, for example, to about 0° C. or 0° C. or below.

The preliminary-cooling heat exchanger 13 performs heat exchange of the source gas 11 cooled to near 0° C. by the refrigerant gas 21, for example, to −80° C. or below.

The liquefaction/supercooling heat exchanger 14 performs heat exchange of the source gas 11 cooled to −80° C. or below by the refrigerant gas 21, for example, to −120° C. or below. The cooling temperature in the respective heat exchangers is a rough indication, and appropriately changed according to the composition of the source gas 11 and conditions of the refrigerant gas 21.

The source gas 11 cooled in the liquefaction/supercooling heat exchanger 14 is expanded by an expansion valve 51 interposed between the liquefaction/supercooling heat exchanger 14 and the separation drum 15 and then introduced into the separation drum 15 connected to the end side of the source-gas supply line $L_1$. In the separation drum 15, the source gas 11 is separated into a gas component of flash gas and a liquefied component of the liquefied natural gas.

Because the flash gas has been cooled, the flash gas is introduced into the refrigerant-gas supply line $L_2$ as the refrigerant gas 21 in order of the liquefaction/supercooling heat exchanger 14, the preliminary-cooling heat exchanger 13, and the room-temperature heat exchanger 12. The flash gas is then used circularly as the refrigerant gas for cooling the source gas 11 in the respective heat exchanging units 14*a*, 13*a*, and 12*a*.

The refrigerant gas 21 used for cooling the source gas 11 is introduced into the compressor 31 provided at the end portion of the refrigerant-gas supply line $L_2$. The compressor 31 is a two-stage compressor in the present embodiment, but is not limited thereto, and can be installed in a plurality of stages more than two. The refrigerant gas 21 is compressed to a predetermined pressure (to the same level as the source gas) by the compressor 31, mixed with the source gas 11 again in the mixing unit 32, and recirculated.

The liquefied natural gas (LNG) of the liquefied component separated by the separation drum 15 is separately collected as a product.

According to the present embodiment, the part 11*a* of the source gas 11 heat-exchanged in the preliminary-cooling heat exchanger 13 provided in the source-gas supply line $L_1$ is extracted by the extraction line $L_4$, and adiabatically expanded by the expansion turbine 33 connected to the end of the extraction line $L_4$. Thereby the cooling source gas 34 temperature-dropped, for example, to −150° C. or below can be acquired.

The acquired cooling source gas 34 is joined with the refrigerant gas 21 at a refrigerant joining portion 41 provided in the refrigerant-gas supply line $L_2$ between the liquefaction/supercooling heat exchanger 14 and the separation drum 15 on the upstream side of the liquefaction/supercooling heat exchanger 14 via the cooling source-gas supply line $L_5$. By joining the cooling source gas 34 with the refrigerant gas 21 in the refrigerant joining portion 41, the refrigerant for a heat exchange capacity required for cooling in the liquefaction/supercooling heat exchanger 14, the preliminary-cooling heat exchanger 13, and the room-temperature heat exchanger 12 is supplied.

Therefore, the extraction amount to be extracted of the part 11*a* of the source gas 11 heat-exchanged by the preliminary-cooling heat exchanger 13 is adjusted by an adjustment unit (not illustrated) or in advance, so as to acquire a heat capacity for cooling the source gas 11 to a predetermined temperature by the cooling source gas 34 acquired by the expansion turbine 33.

An operation of the gas liquefaction apparatus 10A according to the present embodiment is described with reference to FIG. 1. The source gas 11 at a predetermined pressure (40 k) is first supplied by the source-gas supply line $L_1$, to form a supply gas stream. In the source-gas supply line $L_1$, the room-temperature heat exchanger 12, the preliminary-cooling heat exchanger 13, and the liquefaction/supercooling heat exchanger 14 respectively including the heat exchanging units 12*a*, 13*a*, and 14*a* are provided sequentially in a flow direction of the source gas 11.

The source gas 11 cooled and liquefied sequentially by the refrigerant gas 21 in the room-temperature heat exchanger 12, the preliminary-cooling heat exchanger 13, and the liquefaction/supercooling heat exchanger 14 is expanded by the expansion valve 51 installed in front of the separation drum 15 provided in the end zone at the end of the source-gas supply line $L_1$, and then separated into a gas component and a liquefied component. The liquefied component is delivered, for example, to a storage tank or a pipeline as liquefied natural gas (LNG).

Because the gas component separated by the separation drum has been cooled, the gas component is delivered to the refrigerant-gas supply line $L_2$ from a top portion of the separation drum 15 as the refrigerant gas 21, to form a refrigerant gas stream. The refrigerant gas 21 flows in a direction opposite to the supply direction of the source gas 11 from the liquefaction/supercooling heat exchanger 14, the preliminary-cooling heat exchanger 13, and the room-temperature heat exchanger 12, to cool the source gas 11 indirectly in the respective heat exchanging units 14*a*, 13*a*, and 12*a*. By the heat exchange and cooling by the refrigerant gas 21, the liquefied component of the source gas 11 is separated as liquefied natural gas (LNG), and the unliquefied gas component that has not been liquefied is used for cooling as the refrigerant gas 21. After having contributed to cooling, the refrigerant gas 21 is delivered to the compressor 31 provided in the end zone at the end of the refrigerant-gas supply line $L_2$ and compressed to the same level as the gas pressure of the source gas 11. The compressed gas 22 that has been compressed is mixed with the source gas 11 in the mixing unit 32, and is supplied again as the source gas 11. Accordingly, the open loop cycle process is constructed in which the unliquefied gas of the source gas 11 is used as the refrigerant gas 21, and is mixed with the source gas 11 again and liquefied, and circulated and reused.

According to the present embodiment, the part 11*a* of the source gas 11 cooled in the preliminary-cooling heat exchanger 13 provided in the source-gas supply line $L_1$ is extracted by the extraction line $L_4$, and adiabatically expanded by the expansion turbine 33 connected to the end of the extraction line $L_4$, thereby acquiring the cooling source gas 34 temperature-dropped, for example, to −150° C. or below.

The acquired cooling source gas 34 is joined with the refrigerant gas 21 in the refrigerant joining portion 41 provided in the refrigerant-gas supply line $L_2$ between the liquefaction/supercooling heat exchanger 14 and the separation drum 15 on the upstream side of the liquefaction/supercooling heat exchanger 14 via the cooling source-gas supply line $L_5$. Due to this joining, the cooling source gas 34 is supplied to the refrigerant gas 21, so that a heat exchange amount required for cooling in the liquefaction/supercooling heat exchanger 14, the preliminary-cooling heat exchanger 13, and the room-temperature heat exchanger 12 is supplied.

In this manner, only the refrigerant gas 21 separated by the separation drum 15 cannot cool the source gas 11 sufficiently. Therefore, the part 11*a* of the source gas 11 heat-exchanged in the preliminary-cooling heat exchanger 13 is extracted, and introduced into the expansion turbine 33 to be adiabatically expanded, thereby acquiring the cooling source gas 34. The cooling source gas 34 is joined with the refrigerant gas 21 in the refrigerant joining portion 41 in the refrigerant-gas supply line $L_2$, thereby enabling to acquire the refrigerant gas 21 having the cooling amount sufficient for cooling the source gas 11 sequentially in the respective heat exchanging units 14*a*, 13*a*, and 12*a*.

Further, the power of the compressor 31 is collected by the power of the expansion turbine 33 connected coaxially to enable reduction of the compression power. Coolers 31*a* and 31*b* are provided in the compressor 31 to cool the compressed gas.

According to the present embodiment, the heat exchanging facility has a simple configuration such that the source-gas stream line and the refrigerant-gas stream line are provided in the direction opposite to each other to perform heat exchange sequentially in the heat exchanging units 12*a*, 13*a*, and 14*a* of the room-temperature heat exchanger 12, the preliminary-cooling heat exchanger 13, and the liquefaction/supercooling heat exchanger 14. Accordingly, a complicated heat exchange loop is not required, and facility cost reduction and power reduction can be realized.

A gas liquefaction method according to one or more embodiments of the present invention is a gas liquefaction manufacturing method of an open loop cycle process in which the source gas (for example, natural gas) 11 is cooled up to a liquefaction temperature to manufacture liquefied natural gas (LNG) of a gas liquefied substance from the cooled gas component and the liquefied component. The gas liquefaction method includes a heat-exchange step of heat-exchanging the cooled gas component as the refrigerant gas 21 in at least two heat exchanging units (in the present embodiment, three heat exchanging units 14*a*, 13*a*, 12*a*), while supplying the refrigerant gas 21 in the direction opposite to the supply direction of the source gas 11, an adiabatic expansion step of extracting the part 11*a* of the source gas 11 after being cooled in the heat exchanging unit 13*a* of the preliminary-cooling heat exchanger 13, for example, between the heat exchanging unit 13*a* of the preliminary-cooling heat exchanger 13 and the heat exchanging unit 14*a* of the liquefaction/supercooling heat exchanger 14 and adiabatically expanding the part 11*a* of the source gas 11 by the expansion turbine 33, and a refrigerant-gas supply step of supplying the cooling source gas 34 temperature-dropped at the adiabatic expansion step to the refrigerant gas 21.

According to the present embodiment, the extraction line $L_4$ branched from the source-gas supply line $L_1$ between the preliminary-cooling heat exchanger 13 and the liquefaction/supercooling heat exchanger 14 to extract the part 11*a* of the source gas 11 heat-exchanged in the preliminary-cooling heat exchanger 13 is provided. However, the present invention is not limited thereto. For example, an extraction line $L_4$ for extracting the part 11*a* of the source gas 11 heat-exchanged in the room-temperature heat exchanger 12 from a position between the room-temperature heat exchanger 12 and the preliminary-cooling heat exchanger 13 provided in the source-gas supply line $L_1$ can be provided. Thereby the part 11*a* of the source gas 11 is delivered to the expansion turbine 33 to be adiabatically expanded in the expansion turbine 33, to acquire the temperature-dropped cooling source gas 34. The acquired cooling source gas 34 can be joined with the refrigerant gas 21 in the refrigerant joining portion 41, to supply a refrigerant body having a sufficient cooling capacity.

Second Embodiment

Figures 1, 2:
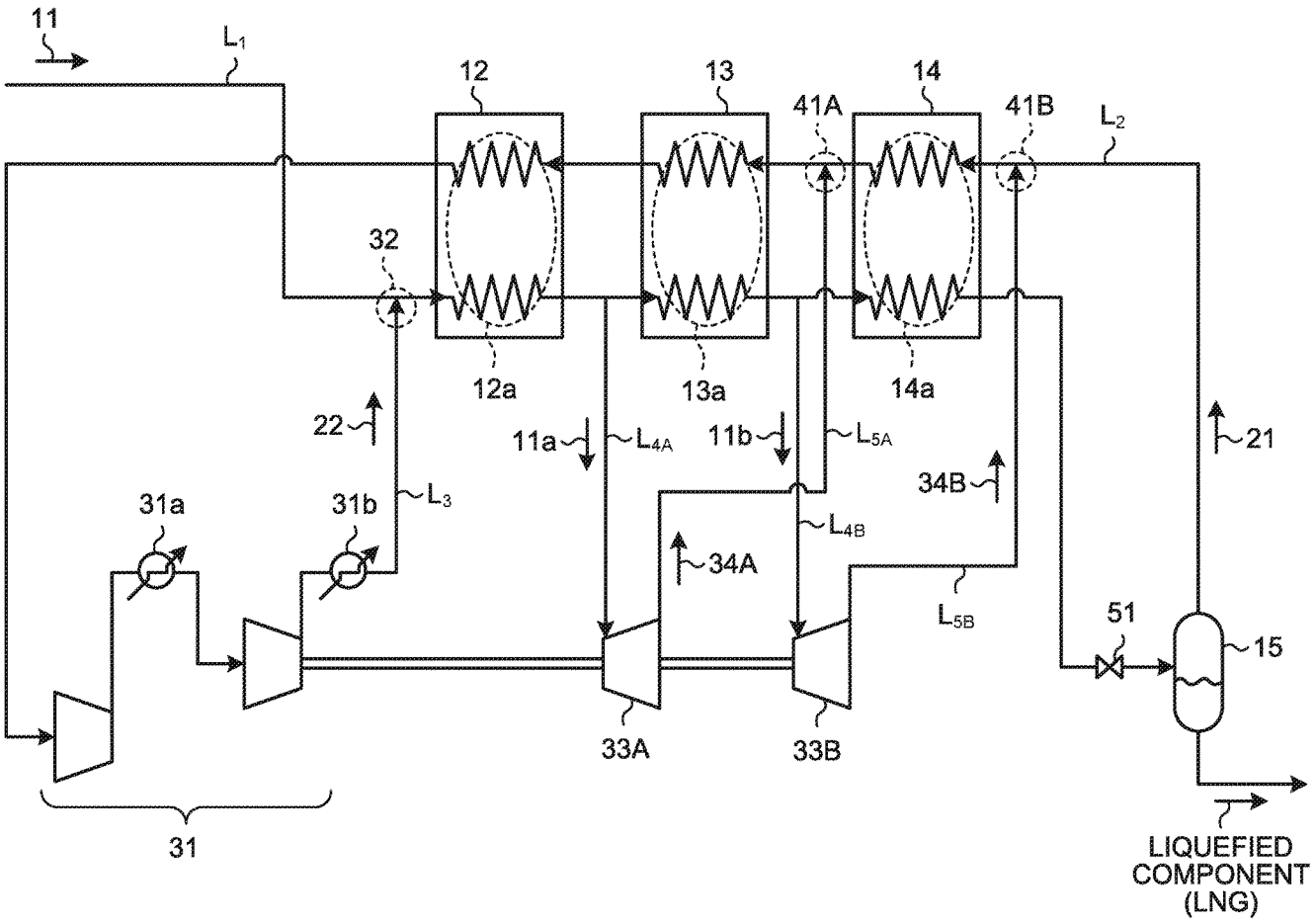
Figure 2:
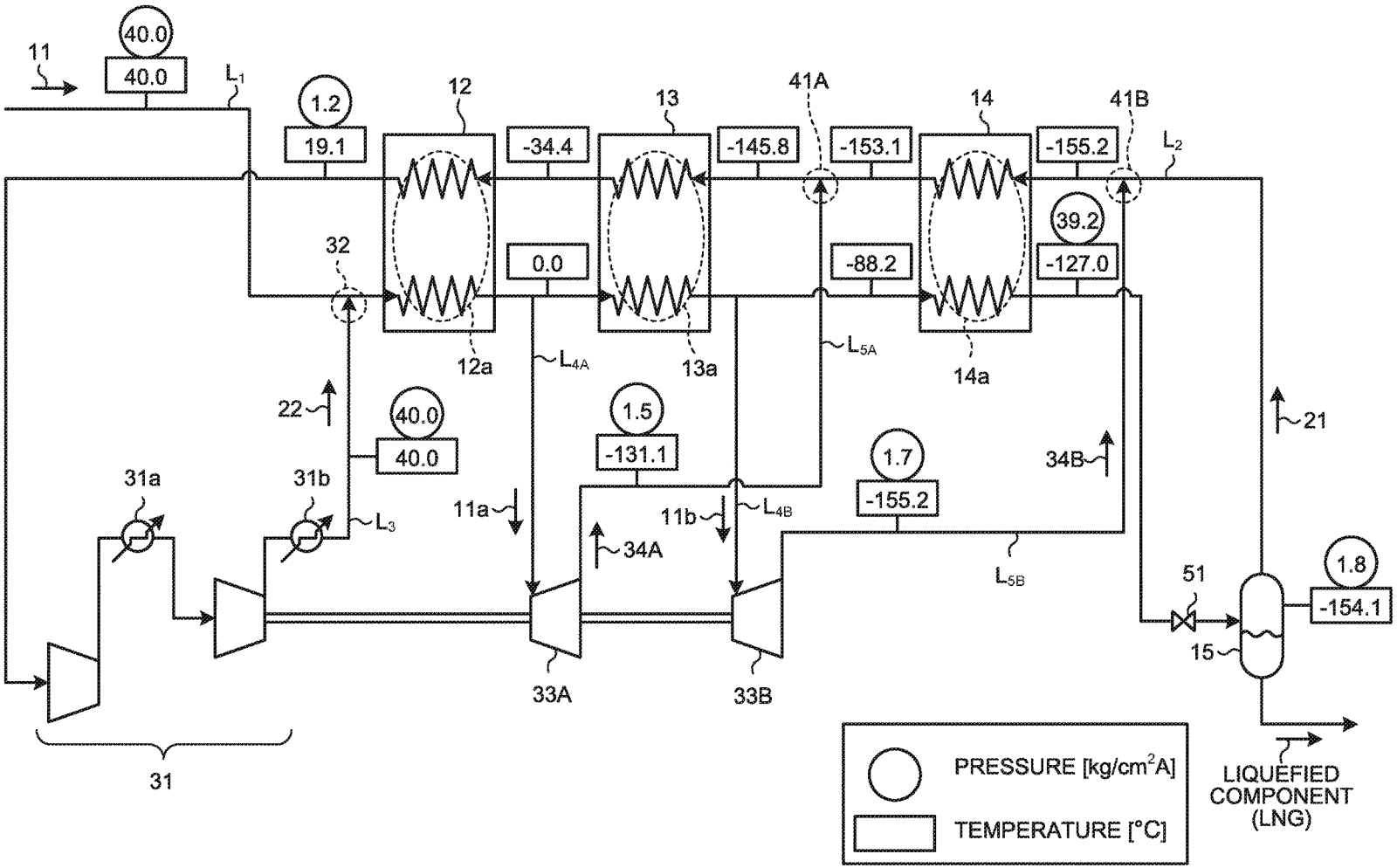

A gas liquefaction apparatus according to a second embodiment of the present invention is described with reference to the drawings. FIG. 2-1 is a schematic diagram of the gas liquefaction apparatus according to the second embodiment. Configurations identical to those of the gas liquefaction apparatus according to the first embodiment illustrated in FIG. 1 are denoted by like reference signs and detailed explanations thereof will be omitted. As illustrated in FIG. 2-1, a gas liquefaction apparatus 10B of the second embodiment includes a first extraction line $L_{4A}$ branched from the source-gas supply line $L_1$ between the room-temperature heat exchanger 12 and the preliminary-cooling heat exchanger 13 in the gas liquefaction apparatus 10A in FIG. 1, to extract the part 11*a* of the source gas 11 heat-exchanged in the room-temperature heat exchanger 12, and a warm expansion turbine 33A connected with an end of the first extraction line $L_{4A}$ to adiabatically expand the part 11*a* of the source gas 11 extracted. The gas liquefaction apparatus 10B also includes a first cooling-source-gas supply line $L_{5A}$ for supplying a first cooling source gas 34A temperature-dropped in the warm expansion turbine 33A to a first refrigerant joining portion 41A in the refrigerant-gas supply line $L_2$ between the preliminary-cooling heat exchanger 13 and the liquefaction/supercooling heat exchanger 14, and a second extraction line $L_{4B}$ branched from the source-gas supply line $L_1$ between the preliminary-cooling heat exchanger 13 and the liquefaction/supercooling heat exchanger 14 to extract a part 11*b* of the source gas 11 heat-exchanged in the preliminary-cooling heat exchanger 13. The gas liquefaction apparatus 10B further includes a cold expansion turbine 33B connected with an end of the second extraction line $L_{4B}$ to adiabatically expand the part 11*b* of the source gas 11 extracted, and a second cooling-source-gas supply line $L_{5B}$ for supplying a second cooling source gas 34B temperature-dropped in the cold expansion turbine 33B to a second refrigerant joining portion 41B of the refrigerant-gas supply line $L_2$ between the liquefaction/supercooling heat exchanger 14 and the separation drum 15.

In the present embodiment, the first cooling source gas 34A acquired in the warm expansion turbine 33A is joined with the refrigerant gas 21 at the first refrigerant joining portion 41A provided in the refrigerant-gas supply line $L_2$ between the preliminary-cooling heat exchanger 13 and the liquefaction/supercooling heat exchanger 14, via the first cooling-source-gas supply line $L_{5A}$.

The second cooling source gas 34B acquired in the cold expansion turbine 33B is joined with the refrigerant gas 21 at the second refrigerant joining portion 41B provided in the refrigerant-gas supply line $L_2$ between the liquefaction/supercooling heat exchanger 14 and the separation drum 15, via the second cooling-source-gas supply line $L_{5B}$.

By joining the first cooling source gas 34A and the second cooling source gas 34B with the refrigerant gas 21 sequentially in the first and second refrigerant joining portions 41A and 41B, the refrigerant having the heat exchange capacity required for cooling in the liquefaction/supercooling heat exchanger 14, the preliminary-cooling heat exchanger 13, and the room-temperature heat exchanger 12 is supplied.

Test Example 1

A test for confirming the effects of the second embodiment of the present invention was performed. FIG. 2-2 is a schematic diagram of a gas liquefaction apparatus according to a test example 1. In FIG. 2-2, examples of the temperature and pressure are respectively described on main lines. In the test example 1, the pressure and temperature are exemplified and described in FIG. 2-2. However, the present invention is not limited thereto. In FIG. 2-2, the pressure (kg/cm$^2$A) is circled, and the temperature (° C.) is enclosed by a square (the same applies in FIG. 5-2).

As illustrated in FIG. 2-2, natural gas having a temperature of 40° C. and a pressure of 40 kg/cm$^2$A was used as the source gas 11 to perform the test.

In the room-temperature heat exchanger 12, the source gas 11 is cooled up to 0° C. by the refrigerant gas 21 at −34.4° C. flowing in the refrigerant-gas supply line $L_2$. A part 11*a* of the source gas 11 at 0° C. is delivered to the warm expansion turbine 33A, where the part 11*a* of the source gas 11 becomes the first cooling source gas 34A at −131.1° C. The first cooling source gas 34A is joined with the refrigerant gas 21 in the first refrigerant joining portion 41A and then mixed with the refrigerant gas 21 at −153.1° C. flowing in the refrigerant-gas supply line $L_2$ to become the refrigerant gas 21 at −145.8° C. and is introduced into the preliminary-cooling heat exchanger 13.

In the preliminary-cooling heat exchanger 13, the source gas 11 is cooled by the refrigerant gas 21 at −145.8° C. flowing in the refrigerant-gas supply line $L_2$, and cooled from 0° C. to −88.2° C. The part 11*b* of the source gas 11 at −88.2° C. is delivered to the cold expansion turbine 33B, where the part 11*b* of the source gas 11 becomes the second cooling source gas 34B at −155.2° C. The second cooling source gas 34B is joined with the refrigerant gas 21 in the second refrigerant joining portion 41B and then mixed with the refrigerant gas 21 at −154.1° C. flowing in the refrigerant-gas supply line $L_2$ to become the refrigerant gas 21 at −155.2° C. and is introduced into the liquefaction/supercooling heat exchanger 14.

In the liquefaction/supercooling heat exchanger 14, the source gas 11 is cooled by the refrigerant gas 21 at −155.2° C. flowing in the refrigerant-gas supply line $L_2$, to be cooled from −88.2° C. to −127.0° C.

The source gas 11 cooled to −127.0° C. is expanded by the expansion valve 51 installed in front of the separation drum 15, and is separated by a flash action in the separation drum 15 into the gas component and the liquefied component at −154.1° C. The liquefied component is delivered to the storage tank or the pipeline as liquefied natural gas (LNG). The gas component is delivered to the refrigerant-gas supply line $L_2$ as the refrigerant gas 21 and is circulated and used.

The refrigerant gas 21 contributes to cooling, and then becomes gas having a temperature of 19.1° C. and a pressure of 1.2 kg/cm$^2$A, and is delivered to the compressor 31 provided in the end zone at the end of the refrigerant-gas supply line $L_2$. In the compressor 31, the refrigerant gas 21 is compressed to the same level of a gas pressure of the source gas 11, that is, a temperature of 40° C. and a pressure of 40.0 kg/cm$^2$A, and joined with the source gas 11 in the mixing unit 32 and liquefied again.

Third Embodiment

Figure 3:
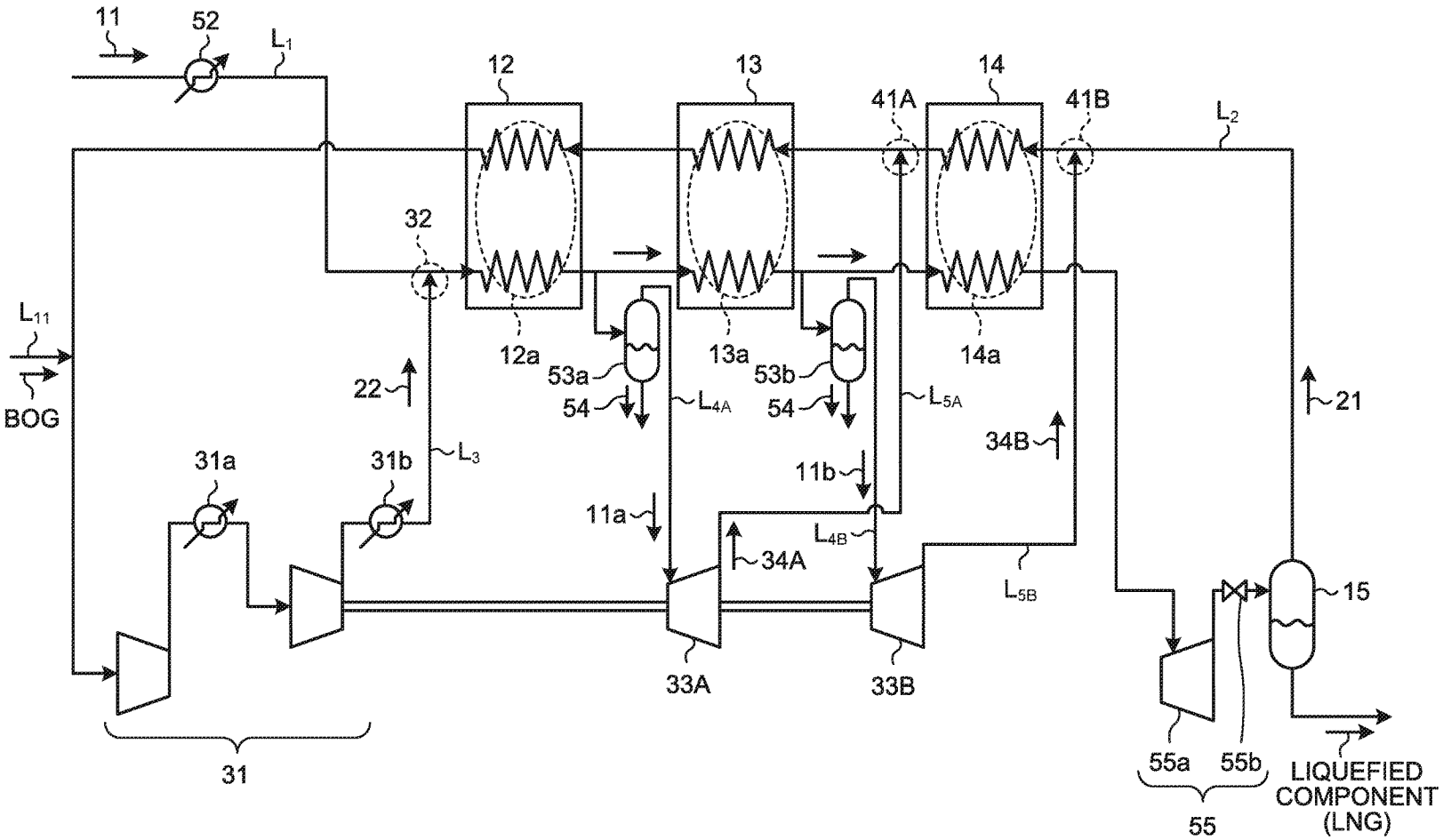
FIG. 3 is a schematic diagram of a gas liquefaction apparatus according to a third embodiment.

A gas liquefaction apparatus according to a third embodiment of the present invention is described with reference to the drawings. FIG. 3 is a schematic diagram of the gas liquefaction apparatus according to the third embodiment. Configurations identical to those of the gas liquefaction apparatuses according to the first and second embodiments are denoted by like reference signs and detailed explanations thereof will be omitted. As illustrated in FIG. 3, in a gas liquefaction apparatus 10C according to the present embodiment, a preliminary cooler 52 is provided on an upstream side of the room-temperature heat exchanger 12 in the source-gas supply line $L_1$ for supplying the source gas 11 in the gas liquefaction apparatus 10B in FIG. 2-1, to preliminarily cool the source gas 11, thereby realizing power reduction of the compressor 31.

Further, on a front side of the compressor 31 between the room-temperature heat exchanger 12 and the compressor 31 in the refrigerant-gas supply line $L_2$, a boil-off gas supply line $L_{11}$ is connected to supply boil-off gas (BOG) partially gasified by natural heat input, for example, in the LNG facilities from outside. By supplying the BOG via the boil-off gas supply line $L_{11}$ and joining the BOG with the refrigerant gas 21 after having contributed to cooling, the BOG can be effectively re-liquefied. Accordingly, a re-liquefaction facility only for the BOG is not required.

Further, in the present embodiment, a heavy-component separating unit 53*a* is provided in the first extraction line $L_{4A}$ for extracting the part 11*a* of the source gas 11 cooled by the room-temperature heat exchanger 12, to separate a heavy component liquid generated at the time of being cooled in the room-temperature heat exchanger 12. Further, in the present embodiment, a heavy-component separating unit

53*b* is provided in the second extraction line $L_{4B}$ for extracting the part 11*b* of the source gas 11 cooled by the preliminary-cooling heat exchanger 13, to separate a heavy component liquid generated at the time of being cooled in the preliminary-cooling heat exchanger 13. If any liquid is not generated under the cooling conditions in the preliminary-cooling heat exchanger 13, installation of the heavy-component separating unit 53*b* may be unnecessary. Accordingly, by removing the heavy component, solidification in the heat exchanger on a wake side is prevented. The separated heavy component 54 is used, for example, as a fuel for driving the turbine.

Further, according to the present embodiment, by providing a liquid expander 55 including a liquefaction expansion turbine 55*a* and a pressure regulation valve 55*b* instead of the expansion valve 51 for expansion provided in front of the separation drum 15, consumed energy in the liquefaction process can be collected as electric energy.

Fourth Embodiment

Figure 4:
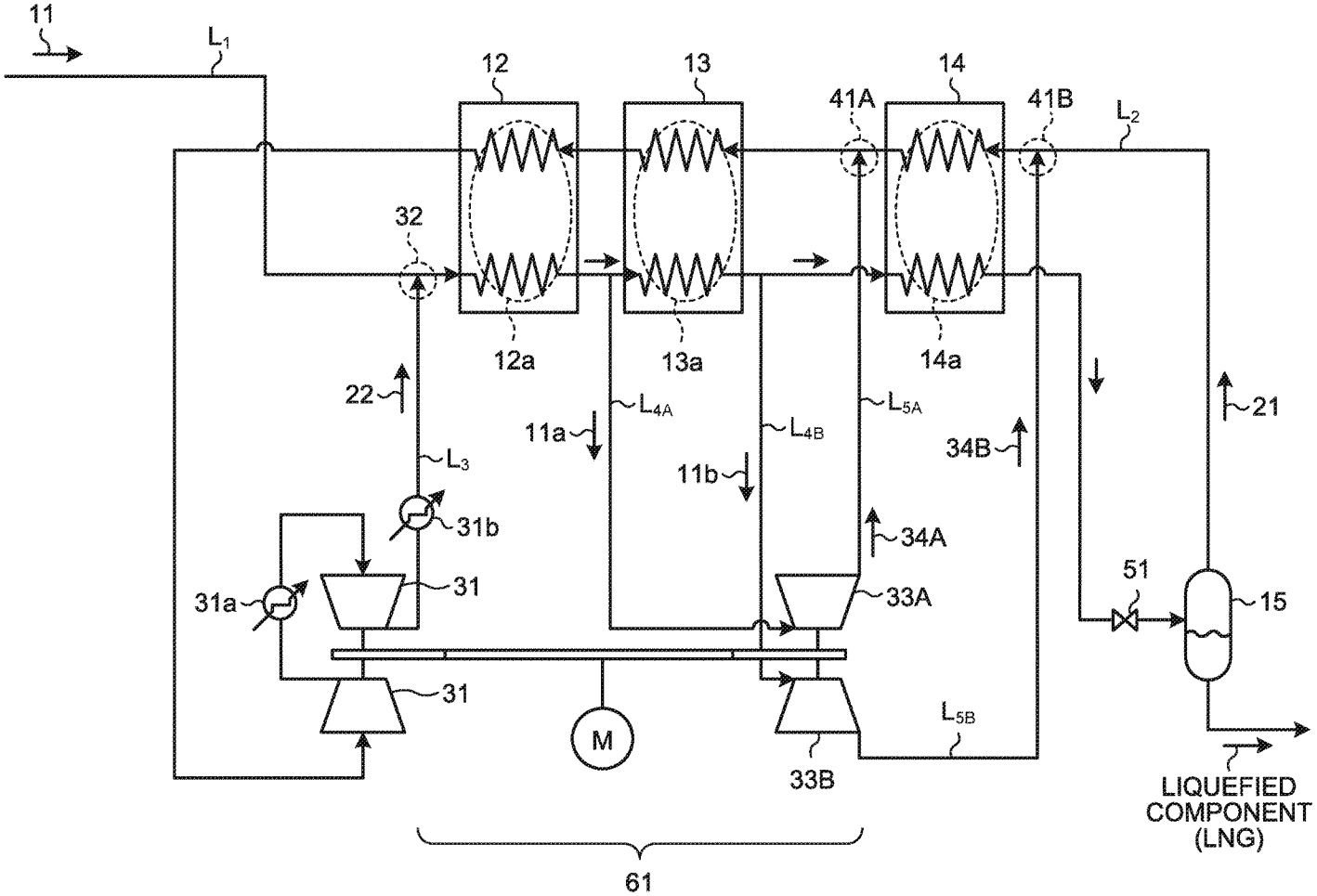
FIG. 4 is a schematic diagram of a gas liquefaction apparatus according to a fourth embodiment.

A gas liquefaction apparatus according to a fourth embodiment of the present invention is described with reference to the drawings. FIG. 4 is a schematic diagram of the gas liquefaction apparatus according to the fourth embodiment. Configurations identical to those of the gas liquefaction apparatuses according to the first and second embodiments are denoted by like reference signs and detailed explanations thereof will be omitted. As illustrated in FIG. 4, in a gas liquefaction apparatus 10D according to the present embodiment, the compressor 31, the warm expansion turbine 33A, and the cold expansion turbine 33B in the gas liquefaction apparatus 10B in FIG. 2-1 are combined to form a geared compander (a centrifugal compressor with built-in speed-up gear) 61, so as to obtain the number of rotations at which the efficiency at respective stages becomes optimum.

In the present embodiment, by using the geared compander 61, the efficiency of the compressor is improved even more as compared to the second embodiment.

Fifth Embodiment

Figures 1, 5:
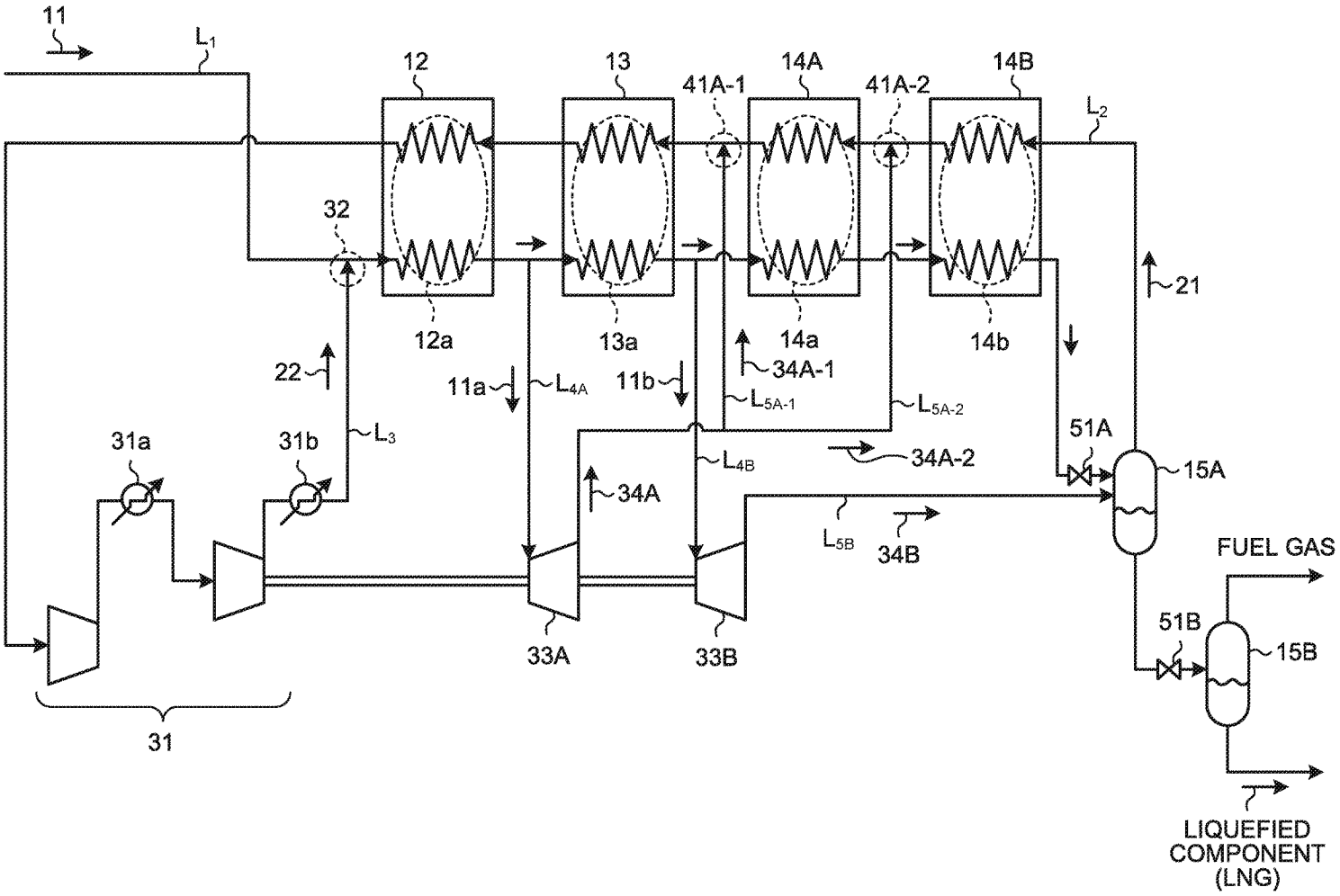
Figures 2, 5:
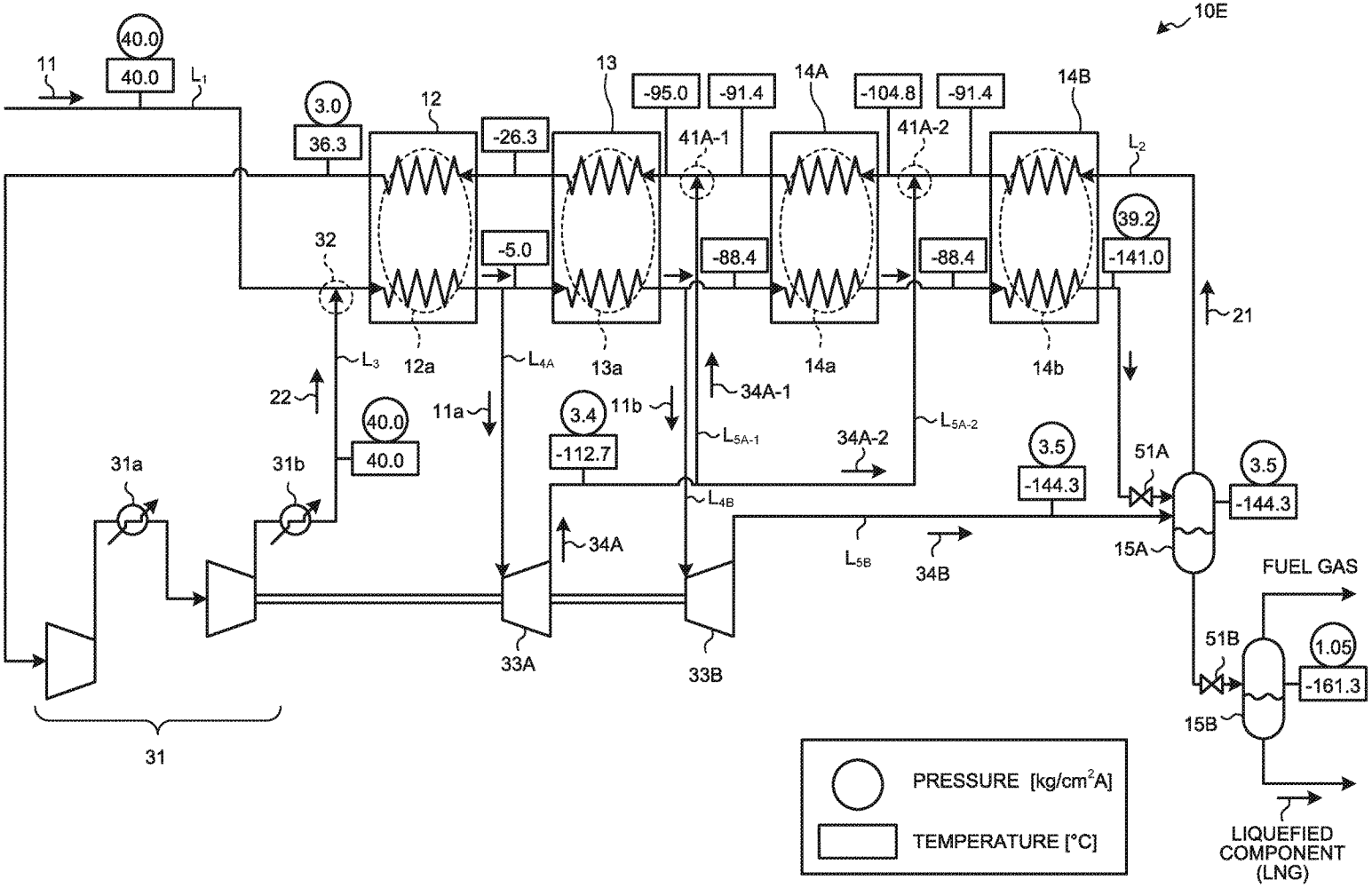

A gas liquefaction apparatus according to a fifth embodiment of the present invention will be described with reference to the drawings. FIG. 5-1 is a schematic diagram of the gas liquefaction apparatus according to the fifth embodiment. Configurations identical to those of the gas liquefaction apparatuses according to the first and second embodiments are denoted by like reference signs and detailed explanations thereof will be omitted. As illustrated in FIG. 5-1, in a gas liquefaction apparatus 10E according to the present embodiment, the liquefaction/supercooling heat exchanger 14 illustrated in FIG. 1 is divided into two heat exchangers to form a liquefaction heat exchanger 14A and a supercooling heat exchanger 14B, and these two heat exchangers which are the liquefaction heat exchanger and the supercooling heat exchanger are provided in series. The first cooling source gas 34A temperature-dropped in the warm expansion turbine 33A is branched into two parts, and the first cooling source gas 34A branched is delivered to a first refrigerant joining portion 41A-1 between the preliminary-cooling heat exchanger 13 and the liquefaction heat exchanger 14A via a first cooling-source-gas supply line $L_{5A-1}$, and to a second refrigerant joining portion 41A-2 between the liquefaction heat exchanger 14A and the supercooling heat exchanger 14B via a first cooling-source-gas supply line $L_{5A-2}$.

The two separation drums 15 are provided, such that a first separation drum 15A and a second separation drum 15B having a different operating pressure are installed.

The refrigerant gas 21 separated by the first separation drum 15A flows in the refrigerant-gas supply line $L_2$ at a pressure higher than the atmospheric pressure, and is heat-exchanged in the respective heat exchanging units 14*b*, 14*a*, 13*a*, and 12*a* of the supercooling heat exchanger 14B, the liquefaction heat exchanger 14A, the preliminary-cooling heat exchanger 13, and the room-temperature heat exchanger 12, and introduced into the side of the compressor 31. Accordingly, the power in the compressor 31 is reduced because the pressure is not released up to the atmospheric pressure as in the first embodiment.

Further, because the second cooling source gas 34B temperature-dropped by the cold expansion turbine 33B has a mixed phase of the gas component and the liquefied component, the second cooling-source-gas supply line $L_{5B}$ is connected to the first separation drum 15A. The second cooling source gas 34B is directly introduced into the first separation drum 15A and flashed therein to separate the gas component and the liquefied component from each other.

The liquefied component separated in the first separation drum 15A is expanded by the expansion valve 51B installed in front of the second separation drum 15B and flashed in the second separation drum 15B, thereby being separated into the gas component and the liquefied component. The liquefied component is delivered to the storage tank or the pipeline as liquefied natural gas (LNG). The gas component is separately used as fuel gas.

Test Example 2

A test for confirming the effects of the fifth embodiment of the present invention was performed. FIG. 5-2 is a schematic diagram of a gas liquefaction apparatus according to a test example 2. In the test example 2, examples of the temperature and pressure are respectively described. However, the present invention is not limited thereto.

As illustrated in FIG. 5-2, natural gas having a temperature of 40° C. and a pressure of 40 kg/cm$^2$A was used as the source gas 11 to perform the test.

In the room-temperature heat exchanger 12, the source gas 11 is cooled by the refrigerant gas 21 at −26.3° C. flowing in the refrigerant-gas supply line $L_2$ and cooled up to −5.0° C. A part 11*a* of the source gas 11 at −5.0° C. is delivered to the warm expansion turbine 33A, where the part 11*a* of the source gas 11 becomes first cooling source gas 34A-1 and first cooling source gas 34A-2 at −112.7° C. The cooling source gas 34A-1 is joined with the refrigerant gas 21 at −91.4° C. flowing in the refrigerant-gas supply line $L_2$ after having been cooled in the liquefaction heat exchanger 14A, at the first refrigerant joining portion 41A-1 to become the refrigerant gas 21 at −95.0° C. and is introduced into the preliminary-cooling heat exchanger 13.

Further, the first cooling source gas 34A-2 at −112.7° C. is joined with the refrigerant gas 21 at −91.4° C. flowing in the refrigerant-gas supply line $L_2$ after having been cooled in the supercooling heat exchanger 14B at the second refrigerant joining portion 41A-2 to become the refrigerant gas 21 at −104.8° C. and is introduced into the liquefaction heat exchanger 14A.

In the preliminary-cooling heat exchanger 13, the source gas 11 is cooled by the refrigerant gas 21 at −95.0° C.

flowing in the refrigerant-gas supply line $L_2$, to be cooled from −5.0° C. to −88.4° C. The part 11*b* of the source gas 11 at −88.4° C. is delivered to the cold expansion turbine 33B, where the part 11*b* of the source gas 11 becomes the second cooling source gas 34B at −144.3° C. The second cooling source gas 34B is introduced into the first separation drum 15A and flashed to become the refrigerant gas 21 at −144.3° C. and is introduced into the refrigerant-gas supply line $L_2$ and then into the supercooling heat exchanger 14B.

In the supercooling heat exchanger 14B, the source gas 11 is cooled by the refrigerant gas 21 at −144.3° C. flowing in the refrigerant-gas supply line $L_2$, and thus the source gas 11 is cooled from −88.4° C. to −141.0° C.

The source gas 11 cooled to −141.0° C. is expanded by the expansion valve 51A installed in front of the first separation drum 15A, and is then separated by the first separation drum 15A into the gas component and the liquefied component at −144.3° C. and 3.5 kg/cm$^2$A. The liquefied component is expanded by the expansion valve 51B installed in front of the second separation drum 15B, and is then separated by the second separation drum 15B into the gas component and the liquefied component at −161.3° C. and 1.05 kg/cm$^2$A.

The liquefied component is delivered, for example, to the storage tank or the pipeline as liquefied natural gas (LNG). The gas component is used as fuel gas.

The refrigerant gas 21 contributes to cooling, and then becomes gas having a temperature of 36.3° C. and a pressure of 3.0 kg/cm$^2$A, and is delivered to the compressor 31 provided in the end zone at the end of the refrigerant-gas supply line $L_2$, where the refrigerant gas 21 is compressed to the same level of the gas pressure of the source gas 11, that is, a temperature of 40° C. and a pressure of 40.0 kg/cm$^2$A, and mixed with the source gas 11 in the mixing unit 32 and liquefied again. At the time of re-liquefaction, because the refrigerant gas has a higher pressure than that of test example 1, the compression load of the compressor can be reduced, thereby enabling to reduce the power.

As a result, in the present test example 2, significant improvement can be realized in a basic unit in manufacturing as compared to the test example 1.

REFERENCE SIGNS LIST

10A to 10E gas liquefaction apparatus
11 source gas
12 room-temperature heat exchanger
13 preliminary-cooling heat exchanger
14 liquefaction/supercooling heat exchanger
14A liquefaction heat exchanger
14B supercooling heat exchanger
15 separation drum
21 refrigerant gas
22 compressed gas
31 compressor
32 mixing unit
$L_1$ source-gas supply line
$L_2$ refrigerant-gas supply line
$L_3$ compressed-gas extraction line
$L_4$ extraction line
$L_5$ cooling source-gas supply line

The invention claimed is:

1. A gas liquefaction apparatus comprising:

a source-gas supply line that supplies source gas;

a plurality of heat exchangers comprising a room-temperature heat exchanger, a preliminary-cooling heat exchanger, and a liquefaction heat exchanger that are provided in series sequentially in the source-gas supply line and that cool the source gas;

a separation drum that separates the source gas containing a condensate, which has been cooled by heat exchange up to a liquefaction temperature of the source gas or below, into a gas component and a liquefied component;

a refrigerant-gas supply line that uses the gas component separated by the separation drum as refrigerant gas to supply the refrigerant gas in a direction opposite to a supply direction of the source gas, in order of the liquefaction heat exchanger, the preliminary-cooling heat exchanger, and the room-temperature heat exchanger;

a compressor provided at an end of the refrigerant-gas supply line downstream of the room-temperature heat exchanger and that compresses the refrigerant gas used for cooling;

a compressed-gas extraction line that extracts the compressed refrigerant gas, wherein the source gas supply line is upstream, in a flow direction of the source gas, of the plurality of heat exchangers, and the compressed refrigerant gas mixes with the source gas by connecting an end of the compressed-gas extraction line to the source-gas supply line at an upstream side of the room-temperature heat exchanger to supply the compressed refrigerant gas to the room-temperature heat exchanger;

an extraction line branched from the source-gas supply line at a position between the preliminary-cooling heat exchanger and the liquefaction heat exchanger that extracts a portion of the source gas between the preliminary-cooling heat exchanger and the liquefaction heat exchanger;

an expansion turbine connected with an end of the extraction line and that adiabatically expands at least a portion of the extracted source gas; and a cooling source-gas supply line that supplies cooling source gas from the expansion turbine to the refrigerant-gas supply line, wherein the refrigerant-gas supply line is disposed upstream, in a flow direction of the refrigerant gas, of the plurality of heat exchangers and between the liquefaction heat exchanger and the separation drum and the cooling source gas from the expansion turbine and the gas component from the separation drum pass through all of the plurality of heat exchangers via the refrigerant-gas supply line as one line.

2. A gas liquefaction apparatus comprising:

a source-gas supply line that supplies source gas;

a plurality of heat exchangers comprising a room-temperature heat exchanger, a preliminary-cooling heat exchanger, and a liquefaction heat exchanger that are provided in series sequentially in the source-gas supply line and that cool the source gas by heat exchange with a refrigerant gas;

a separation drum provided at an end of the source-gas supply line and that separates cooled source gas containing a condensate into a gas component and a liquefied component;

a refrigerant-gas supply line that uses the gas component separated by the separation drum and cooled as refrigerant gas to supply the refrigerant gas in a direction opposite to a supply direction of the source gas, in order of the liquefaction heat exchanger, the preliminary-cooling heat exchanger, and the room-temperature heat exchanger;

a compressor provided at an end of the refrigerant-gas supply line downstream of the room-temperature heat exchanger and that compresses the refrigerant gas;

a compressed-gas extraction line that extracts the compressed refrigerant gas, wherein the source gas supply line is upstream, in a flow direction of the source gas of the plurality of heat exchangers, and the compressed refrigerant gas mixes with the source gas by connecting an end of the compressed-gas extraction line to the source-gas supply line on an upstream side of the room-temperature heat exchanger to supply the compressed refrigerant gas to the room-temperature heat exchanger;

a first extraction line branched from the source-gas supply line between the room-temperature heat exchanger and the preliminary-cooling heat exchanger that extracts a portion of the source gas heat-exchanged in the room-temperature heat exchanger;

a warm expansion turbine connected with an end of the first extraction line that adiabatically expands a portion of the extracted source gas;

a first cooling-source-gas supply line that supplies first cooling source gas from the warm expansion turbine to the refrigerant-gas supply line between the preliminary-cooling heat exchanger and the liquefaction heat exchanger;

a second extraction line branched from the source-gas supply line between the preliminary-cooling heat exchanger and the liquefaction heat exchanger that extracts a portion of the source gas heat-exchanged in the preliminary-cooling heat exchanger;

a cold expansion turbine connected with an end of the second extraction line that adiabatically expands a portion of the extracted source gas; and a second cooling-source-gas supply line that supplies a second cooling source gas from the cold expansion turbine to the refrigerant-gas supply line, wherein the refrigerant-gas supply line is disposed upstream, in a flow direction of the refrigerant gas, of the plurality of heat exchangers and between the liquefaction heat exchanger and the separation drum and the second cooling source gas from the cold expansion turbine and the gas component from the separation drum pass through all of the plurality of heat exchangers via the refrigerant-gas supply line as one line.

3. The gas liquefaction apparatus according to claim 2, wherein an additional liquefaction heat exchanger is disposed after the liquefaction heat exchanger and the liquefaction heat exchanger and the additional liquefaction heat exchanger are provided in series, and the first cooling source gas in the warm expansion turbine is branched into two parts, a branched first cooling source gas is supplied to a refrigerant-gas supply line between the preliminary-cooling heat exchanger and the liquefaction heat exchanger, and a branched second cooling source gas is supplied between the liquefaction heat exchanger and the additional liquefaction heat exchanger.

4. The gas liquefaction apparatus according to claim 1, wherein a cooler that cools the source gas is provided in the source-gas supply line at an upstream side of the room-temperature heat exchanger.

5. The gas liquefaction apparatus according to claim 1, further comprising a heavy component separator that separates a heavy component from an extraction liquid acquired by extracting a portion of the source gas.

6. The gas liquefaction apparatus according to claim 1, wherein a boil-off gas supply line that supplies boil-off gas is provided in the refrigerant-gas supply line between the compressor and the room-temperature heat exchanger.

7. A gas liquefaction method of an open loop cycle process in which source gas is cooled up to a liquefaction temperature to manufacture a gas liquefied substance from a cooled gas component and a liquefied component, the gas liquefaction method comprising:

a plurality of heat exchange steps comprising a room-temperature heat exchange step, a preliminary-cooling heat exchange step, and a liquefaction heat exchange step of sequentially cooling the source gas supplied from a source-gas line;

a separation step of separating the source gas containing a condensate, which has been cooled by heat exchange up to the liquefaction temperature of the source gas or below, into a gas component and a liquefied component;

a refrigerant-gas supply step, in a refrigerant-gas supply line, of using the gas component separated in the separation step as refrigerant gas to supply the refrigerant gas in a direction opposite to a supply direction of the source gas, in order of the liquefaction heat exchange step, the preliminary-cooling heat exchange step, and the room-temperature heat exchange step;

a compressing step, in an end of the refrigerant-gas supply line downstream of the room-temperature heat exchange step, of compressing the refrigerant gas used for cooling;

a compressed-gas extraction step, in a compressed-gas extraction line, of extracting the compressed refrigerant gas;

a mixing step, upstream in a flow direction of the source gas of the plurality of heat exchange steps, of mixing the compressed refrigerant gas and the source gas by connecting an end of the compressed-gas extraction line to the source-gas supply line at an upstream side of the room-temperature heat exchange step to supply the compressed refrigerant gas to the room-temperature heat exchange step;

an expansion step, in an expansion turbine, of adiabatically expanding a portion of the extracted source gas, wherein the expansion turbine is connected with an end of an extraction line branched from the source-gas supply line between the preliminary-cooling heat exchange step and the liquefaction heat exchange step, and the extraction line extracts a portion of the source gas between the preliminary-cooling heat exchange step and the liquefaction heat exchange step; and a cooling source-gas supply step of supplying cooling source gas from the expansion step to the refrigerant-gas supply line, wherein the refrigerant-gas supply line is disposed upstream, in a flow direction of the refrigerant gas, of the plurality of heat exchangers and the cooling source gas from the expansion step and the gas component from the separation step pass through all of the plurality of heat exchangers via the refrigerant-gas supply line as one line, and the cooling source-gas supply step is between the liquefaction heat exchange step and the separation step.

8. A gas liquefaction method of an open loop cycle process in which source gas is cooled up to a liquefaction temperature to manufacture a gas liquefied substance from a cooled gas component and a liquefied component, the gas liquefaction method comprising:

a plurality of heat exchange steps comprising a room-temperature heat exchange step, a preliminary-cooling heat exchange step, and a liquefaction heat exchange step of sequentially cooling the source gas supplied from a source-gas line;

a separation step of separating the source gas containing a condensate into a gas component and a liquefied component in an end of the source-gas line;

a refrigerant-gas supply step, in a refrigerant-gas supply line, of using the gas component separated in the separation step as refrigerant gas to supply the refrigerant gas in a direction opposite to a supply direction of the source gas, in order of the liquefaction heat exchange step, the preliminary-cooling heat exchange step, and the room-temperature heat exchange step;

a compressing step, in an end of the refrigerant-gas supply line downstream of the room-temperature heat exchange step, of compressing the refrigerant gas used for cooling;

a compressed-gas extraction step, in a compressed-gas extraction line, of extracting the compressed refrigerant gas;

a mixing step, upstream in a flow direction of the source gas of the plurality of heat exchange steps, of mixing the compressed refrigerant gas and the source gas by connecting an end of the compressed-gas extraction line to the source-gas supply line at an upstream side of the room-temperature heat exchange step to supply the compressed refrigerant gas to the room-temperature heat exchange step;

a first extraction step, in a first extraction line branched from the source-gas supply line between the room-temperature heat exchange step and the preliminary-cooling heat exchange step, of extracting a portion of the source gas from the room-temperature heat exchange step;

a warm expansion step, in a warm expansion turbine connected with an end of the first extraction line, of adiabatically expanding a portion of the extracted source gas;

a first cooling-source-gas supply step, in a first cooling-source-gas supply line, of supplying first cooling source gas from the warm expansion step to the refrigerant-gas supply line between the preliminary-cooling heat exchange step and the liquefaction heat exchange step;

a second extraction step, in a second extraction line branched from the source-gas supply line between the preliminary-cooling heat exchange step and the liquefaction heat exchange step, of extracting a portion of the source gas from the preliminary-cooling heat exchange step;

a cold expansion step, in a cold expansion turbine connected with an end of the second extraction line, of adiabatically expanding a portion of the extracted source gas; and a second cooling-source-gas supply step, in a second cooling-source-gas supply line, of supplying second cooling source gas from the cold expansion step to the refrigerant-gas supply line, wherein the refrigerant-gas supply line is disposed upstream, in a flow direction of the refrigerant gas, of the plurality of heat exchangers and the second cooling source gas from the cold expansion step and the gas component from the separation step pass through all of the plurality of heat exchangers via the refrigerant-gas supply line as one line, and the second cooling-source-gas supply step is between the liquefaction heat exchange step and the separation step.

* * * * *